US007455497B2

(12) United States Patent
Lee

(10) Patent No.: US 7,455,497 B2
(45) Date of Patent: Nov. 25, 2008

(54) HIGH PERFORMANCE INDUCER

(75) Inventor: JinKook Lee, Concord, OH (US)

(73) Assignee: Carter Cryogenics Company, LLC, Costa Mesa, CA (US)

( * ) Notice: Subject to any disclaimer, the term of this patent is extended or adjusted under 35 U.S.C. 154(b) by 0 days.

(21) Appl. No.: 10/581,875

(22) PCT Filed: Dec. 6, 2004

(86) PCT No.: PCT/US2004/040760

§ 371 (c)(1),
(2), (4) Date: Aug. 28, 2006

(87) PCT Pub. No.: WO2005/057016

PCT Pub. Date: Jun. 23, 2005

(65) Prior Publication Data

US 2007/0160461 A1 Jul. 12, 2007

Related U.S. Application Data

(60) Provisional application No. 60/527,334, filed on Dec. 5, 2003.

(51) Int. Cl.
*F04D 29/38* (2006.01)

(52) U.S. Cl. ..... 415/72; 416/176; 416/177; 416/183; 416/223 R; 62/50.6

(58) Field of Classification Search ..... 415/72, 415/74, 75, 143; 416/176–177, 179, 183, 416/223 R, 234; 62/50.6
See application file for complete search history.

(56) References Cited

U.S. PATENT DOCUMENTS

| | | | | |
|---|---|---|---|---|
| 1,874,450 | A | | 8/1932 | Coats |
| 3,369,715 | A | * | 2/1968 | Carter ..... 222/333 |
| 3,442,220 | A | * | 5/1969 | Mottram et al. ..... 415/218.1 |
| 3,522,997 | A | | 8/1970 | Rylewski |
| 4,904,158 | A | | 2/1990 | Kun |
| 5,947,684 | A | | 9/1999 | Kato et al. |
| 6,435,829 | B1 | | 8/2002 | Meng et al. |

FOREIGN PATENT DOCUMENTS

| | | | | |
|---|---|---|---|---|
| GB | 567368 | A | * | 2/1945 ..... 416/183 |

OTHER PUBLICATIONS

Wood, G.M., et al., "An Experimental Study of Cavitation in a Mixed Flow Pump Impeller", Received Oct. 13, 1959.

* cited by examiner

*Primary Examiner*—Christopher Verdier
(74) *Attorney, Agent, or Firm*—Fay Sharpe LLP

(57) ABSTRACT

An improved high performance inducer for a pump assembly includes a set of primary blades and splitter blades to achieve a vapor-to-liquid ratio up to 1:1. Minimum back pressure is provided at the leading edge to aid in getting fluid into the blades where the vapor component of the pumped fluid is removed. A hub increases in diameter over the axial extent of the helical blades, thereby resulting in a decreasing depth of the blades between the inlet and outlet of the inducer. A substantial improvement in removing fluid from a storage reservoir is obtained resulting in a substantial savings in shipping costs.

12 Claims, 4 Drawing Sheets

HIGH PERFORMANCE INDUCER

CROSS REFERENCE TO RELATED APPLICATIONS

This application claims priority from U.S. Provisional Patent Application Ser. No. 60/527,334 filed Dec. 5, 2003 and is incorporated herein by reference.

BACKGROUND OF THE INVENTION

This present invention relates to pumping assemblies, and finds particular application in pumping cryogenic materials, for example, where the pump assembly is immersed in fluid stored in a reservoir or container, such as a transport ship, and is required to pump the fluid from the bottom of the reservoir.

Pumps that embody inducers for liquid natural gas (LNG) applications such as LNG carrier loading pumps and primary send-out pumps are often required to operate at very low values of net positive suction head required (NPSHR) to facilitate the complete stripping of the storage tanks while maintaining full flow even while operating in full cavitation mode. Additionally, while operating at low tank levels, the pumps can ingest vapors caused by poor suction conditions and vortices. This results in two-phase flow regime.

Under such conditions, inducers in LNG pumps need to be capable of developing sufficient head (pressure) to compress these vapors sufficiently for reabsorption into the liquid in a hydrodynamically stable way. Otherwise it is a well known fact that the pump discharge pressure fluctuates when a column of vapor enters the pump inlet that is not fully reabsorbed. The presence of such fluctuations can cause vibration that can shorten pump life.

U.S. Pat. No. Re 31,445, the details of which are incorporated herein by reference, is directed to a submersible pump assembly of the type for which the improved inducer or high performance inducer was developed. The '445 patent discloses a cryogenic storage system in which a reservoir, storage tank, tank car, tanker ship, etc., includes a casing suspended from an upper closure member or roof. Pipe sections extend from the roof and house a pump and motor unit that is positioned on a floor of the reservoir or storage container. Power is provided through electrical cables and the entire pump and motor assembly is suspended via cable or rigid tubes or pipes.

A foot plate is provided on the lowermost end of the pump and motor assembly. Disposed inwardly from the bottom end is a flow inducer vaned impeller. As described in the '445 patent, a typical inducer impeller includes plural, circumferentially spaced vanes that extend radially outward from a central hub. This structure is generally referred to as a fan-type inducer. Still other manufacturers use a different impeller or inducer configuration such as a mixed flow inducer rather than the four blade fan-type inducer shown in the '445 patent.

Although known fan-type inducer and mixed flow inducer pumps have been used with some success in pump assemblies of this type, they encounter the above-described problem when used to pump a two-phase medium or fluid (i.e., liquid and vapor). As more air than liquid is drawn into the pump assembly because of the design, a substantial amount of the fluid is left in the reservoir. If LNG is shipped in a transport ship, for example, it is offloaded or pumped to a storage reservoir on shore. The inducer is an important element that needs to operate where very low inlet pressure is available. In LNG loading and primary send-out pumps, these conditions exist because the liquid in the tank is at or near saturation pressure (also referred to as true vapor pressure) when the level in the storage tank provides little submergence. In LNG secondary send-out pumps, these conditions can exist because the recondenser is at true vapor pressure when the pipe losses from the boil-off gas recondenser and the pump suction approach the elevation difference between the free liquid surface in the recondenser and the pump inlet (inducer eye).

When these conditions occur, the pressure in the inducer eye becomes equal to true vapor pressure, and any further pressure reduction will result in cavitation, producing bubbles or clouds of bubbles in the fluid. This occurs at the leading edge of the inducer blade when the relative velocity of the fluid with respect to the blade has any incidence angle other than zero. Under other conditions, vapor clouds can be ingested by the pump when suction vortice funnels open between the pump suction and the fluid free surface allowing a stream of vapor to flow into the pump suction. The ratio of vapor to liquid by volume is referred to as V/L or void fraction. The liquid/vapor mixture is two-phase flow. In extreme cases, clouds of bubbles or voids will block the flow and reduce pump output and efficiency.

Known inducer designs leave approximately four feet of LNG in the base of the reservoir of the transport ship. In other words, the reservoir of the ship is not sufficiently emptied and the transport ship is forced to carry residual LNG from the pumping station to a remote location where the transport ship is subsequently refilled. It is estimated that costs associated with this undesired retention and needless shipping of residual LNG that is not pumped from the transport container can cost approximately one hundred thousand dollars ($100,000) per year per foot of residual LNG.

In light of the foregoing, it becomes evident that there is an appreciable need for an improved high performance inducer assembly that would provide a solution to one or more of the deficiencies from which the prior art has suffered. It is still more clear that an improved high performance inducer assembly providing a solution to each of the needs inadequately addressed by the prior art while providing a number of heretofore unrealized advantages thereover would represent a marked advance in the art. Accordingly, a need exists for an improved high performance inducer assembly and particularly an improved high performance inducer to significantly reduce the amount of residual LNG remaining in the ship reservoir after pump off. Likewise, a need exists for more efficient handling or pumping of a two-phase fluid.

BRIEF DESCRIPTION OF THE INVENTION

A new and improved high performance inducer for pumping cryogenic two phase fluids from reservoirs is provided.

More particularly, an inducer impeller for pumping cryogenic two phase fluids from reservoirs includes a hub with a first portion having a first diameter and a second portion with a second diameter larger than the first diameter. A plurality of primary and secondary blades is circumferentially disposed about the hub. Each secondary blade is interposed between two primary blades.

An inducer impeller of a downhole pump assembly for pumping a liquefied gas stored in a reservoir that includes two phase fluid components includes a plurality of primary blades extending from a hub. The primary blades have a generally helical conformation and are circumferentially spaced or disposed about the hub. Secondary blades extend from the hub and are interposed between the plurality of primary blades.

The depth of the plurality of primary and secondary blades is substantially greater at the first portion of the hub than at the second portion of the hub.

An inducer impeller for pumping a two phase fluid from a cryogenic storage system includes a hub which increases in diameter from a first portion to a second portion. Plural, axially extending primary blades each have a leading edge extending radially and axially from the hub. Axially extending secondary blades are circumferentially disposed about the hub such that one of the secondary blades is interposed between two adjacent primary blades. An outer diameter of each primary blade and each secondary blade is generally constant from a leading edge to a trailing edge of such primary and such secondary blades.

A primary benefit of the present invention resides in the ability to achieve a vapor-to-liquid ratio (V/L) of approximately 1:1.

Another benefit of the present invention resides in the ability to substantially reduce the retained or residual fuel left in a reservoir.

Still another benefit resides in the substantial savings associated with the ability to pump off a greater amount of LNG, i.e., to reduce the residual depth of remaining LNG in the reservoir.

Still other benefits and aspects of the invention will become apparent from a reading and understanding of the detailed description of the preferred embodiments hereinbelow.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION OF THE INVENTION

It should, of course, be understood that the description and drawings herein are merely illustrative and that various modifications and changes can be made in the structures disclosed without departing from the spirit of the invention. Like numerals refer to like parts throughout the several views.

Figure 1:
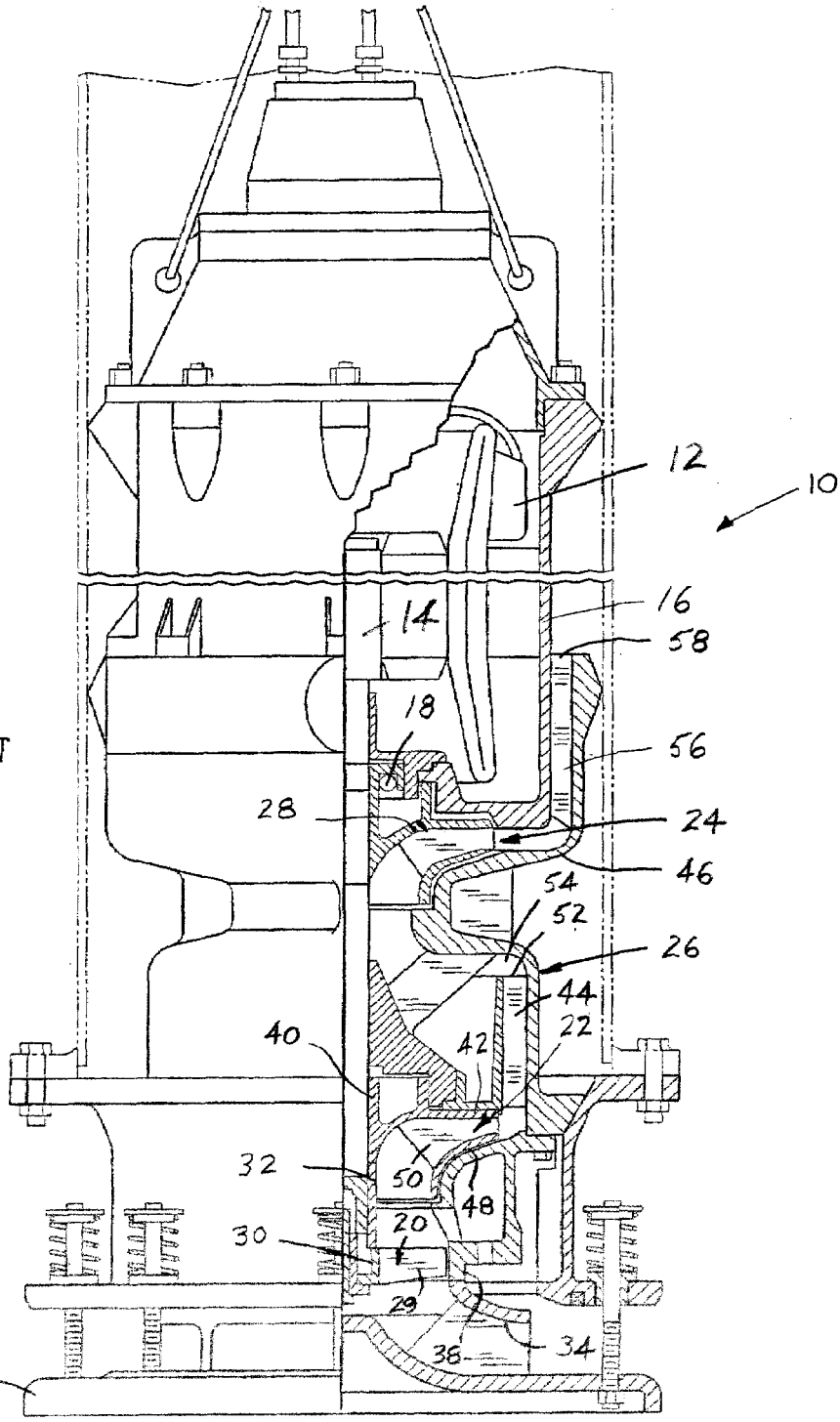
Fig. 1 PRIOR ART
FIG. 1 is a longitudinal cross-sectional view of a prior pumping system disclosed in U.S. Re. 31,445 in which the high performance inducer of FIGS. 2-4 can be incorporated.

With reference to FIG. 1 and as disclosed in U.S. Re. 31,445, a portion of a pump and motor unit 10 for a pumping system for pressurized cryogenic gas storage reservoirs in which an improved inducer of the present invention (to be described in greater detail below in connection with FIGS. 2-4) can be incorporated is illustrated.

As shown in FIG. 1 and described in U.S. Re. 31,445, a conventional induction motor 12 has a vertical motor shaft 14 journalled at its upper end in an antifriction bearing (not shown) carried in an upwardly opening bushing (not shown). The motor shaft 14 is also typically journalled at its bottom end in an open topped cylindrical shell 16 in an antifriction bearing 18. A first or bottom end of the shaft has a high performance inducer 20 mounted thereon and primary and secondary centrifugal vaned impellers 22 and 24 are keyed to the shaft 14 at axially spaced intervals above the flow inducer 20 to form the impellers of a two-stage pump 26. The second stage impeller 24 is vented to the bearing 18 so that pumped fluid may flow from the top bearing (not shown) through the motor 12 to lubricate the lower bearing 18 and then drain through a vent 28 for reintroduction back to the fluid being pumped by the impeller 24.

The high performance inducer 20 has a plurality of circumferentially spaced vanes 29 extending radially of a central hub 30 keyed to the lower end of the motor shaft 14 beneath a spacer 32 as by means of a key (not shown). The high performance inducer 20 thus spans the inlet of the pump and coacts with an inlet fitting 34 opening to the periphery of a foot plate 36 for a foot valve (not shown). This foot plate 36 has upstanding ribs (not shown) at spaced intervals, therearound carrying the shroud fitting 34 which abuts a rim 38 so that fluid flows over the plate 36 under the action of the inducer blades 29 to the primary and secondary impellers 22 and 24.

The primary impeller 22 is of the double shrouded type and includes a central hub 40 abutting the top of the spacer 32 and is keyed to the shaft 14 for corotation. The impeller has a first or top shroud 42 extending radially of the hub 40 to an inlet end of an annular passage 44 inside of a pump housing 46 and surrounding the impeller. A second or bottom shroud 48 coacts with the shroud 42 and with circumferentially spaced upstanding impeller vanes 50 to provide a pumping passage opening axially upward and then radially outward into the annular passageway 44.

Vanes 52 extend radially across the annular passageway 44 at circumferentially spaced intervals and are effective to convert the velocity head from the impeller vanes 50 to a pressure head. The annular passageway 44 discharges beyond the vanes 52 into a flow passage 54 converging to the inlet end of the secondary impeller 24. This secondary impeller is constructed and operates in the same manner as the primary impeller 22 and is driven by the shaft 14 in the same manner. The secondary impeller 24 discharges fluid upwardly through an annular passage 56 containing balancing vanes 58 similar to the vanes 52. The fluid discharges out of an annular open top of the passage 56 into a casing 58 for upward flow therethrough to an outlet fitting (not shown).

Figure 2:
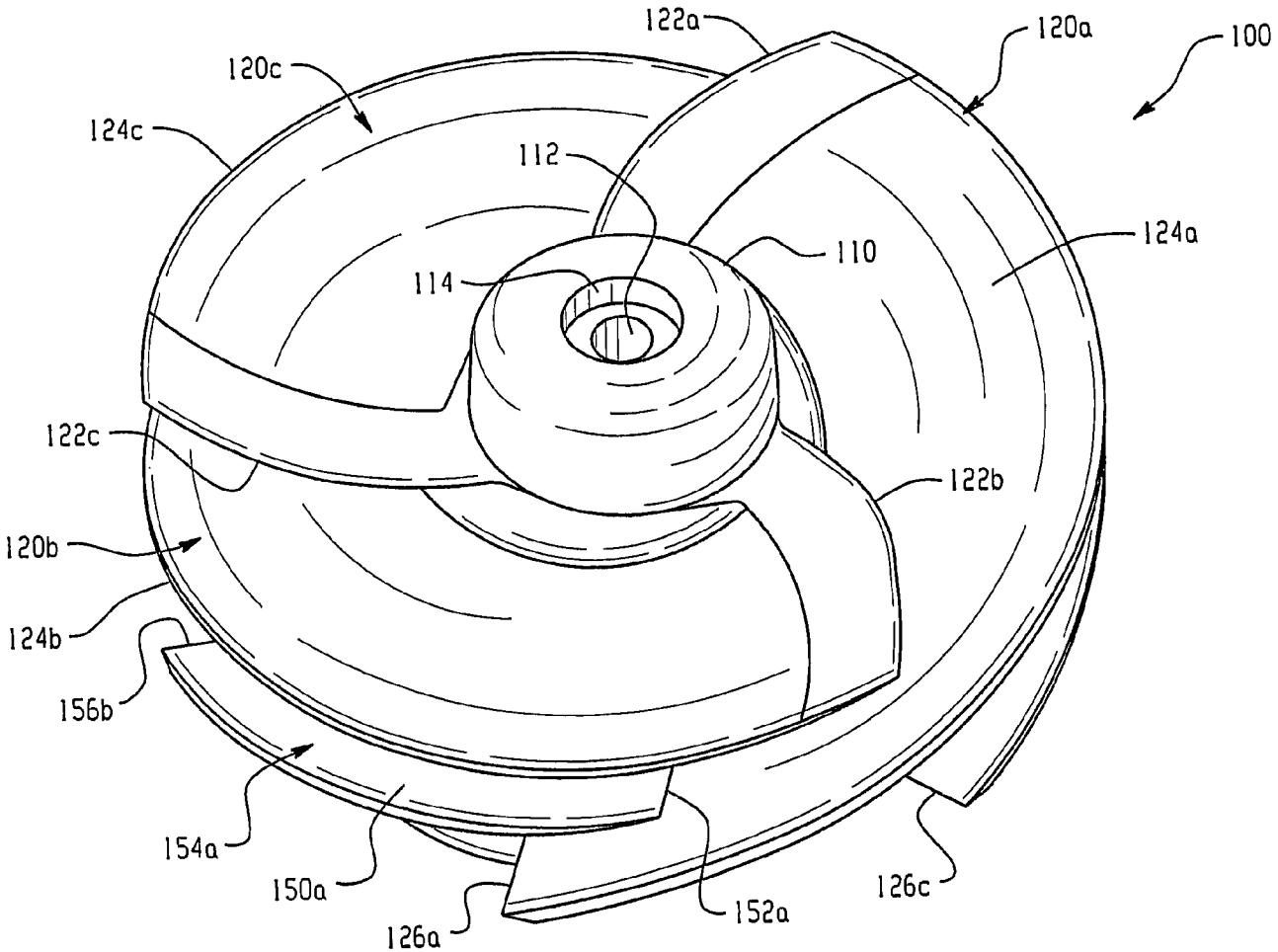
FIG. 2 is a perspective view of the high performance inducer illustrating the hub and blade assembly according to the present invention.
Figure 3:
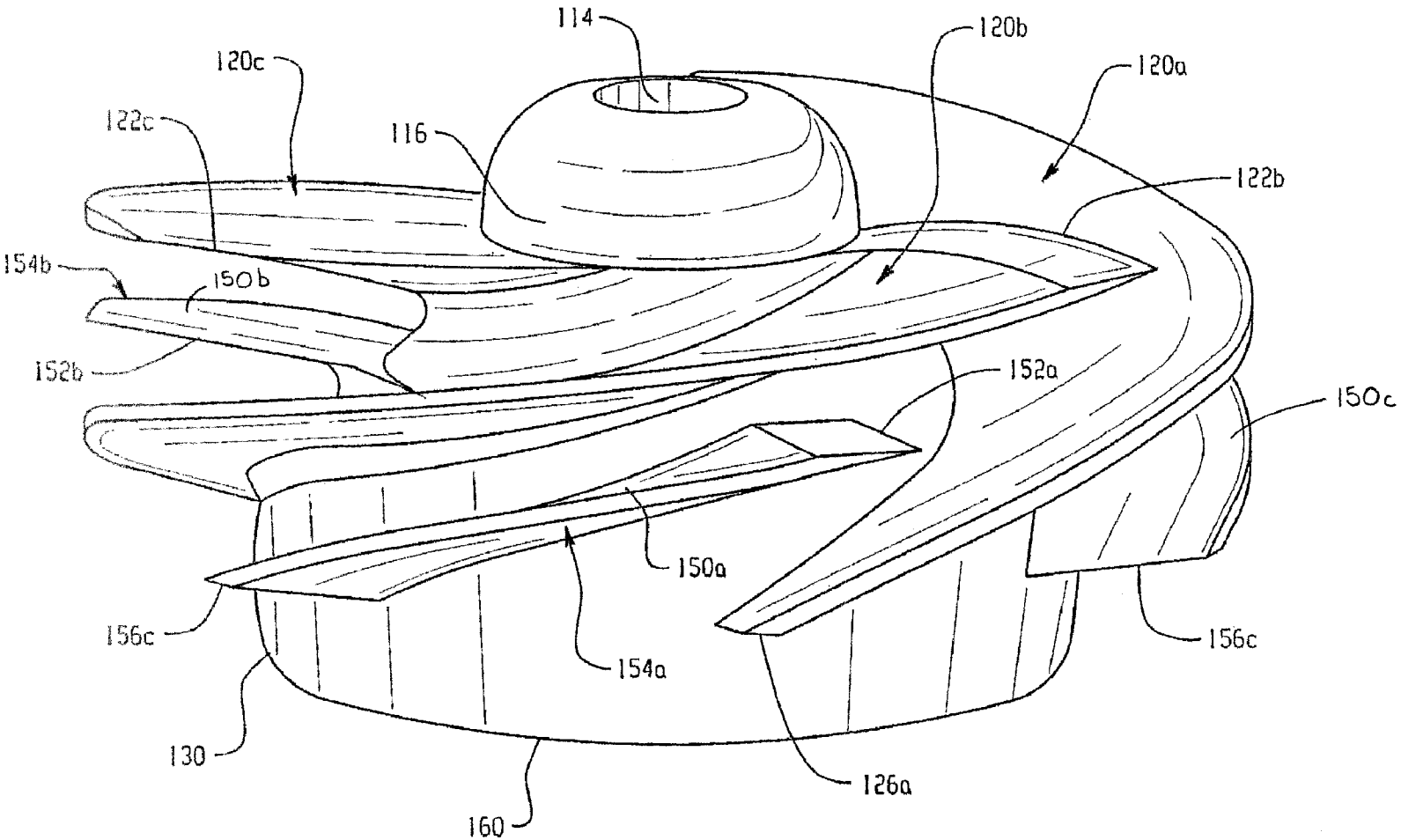
FIG. 3 is an elevational view of the inducer of FIG. 2.
Figure 4:
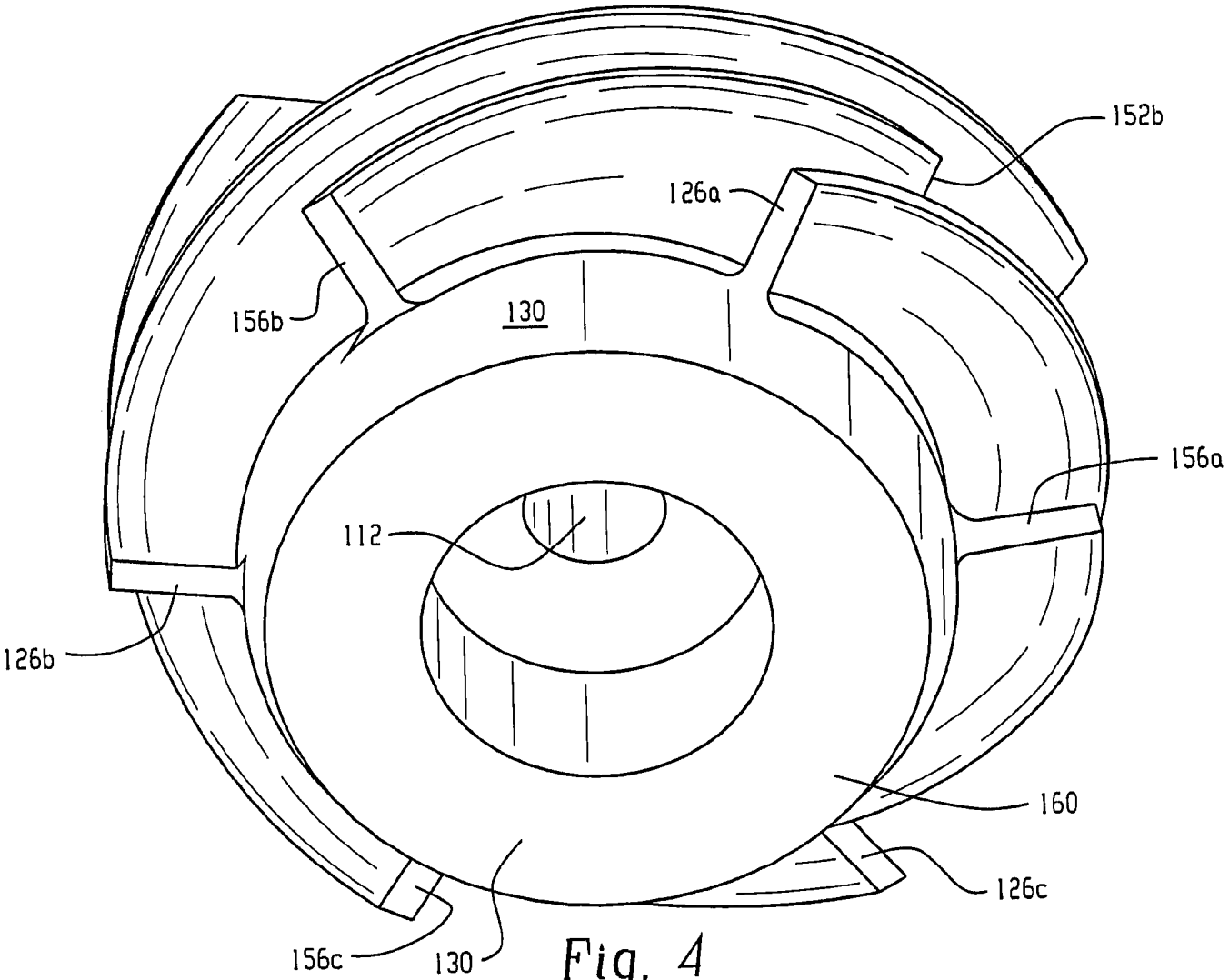
FIG. 4 is a rear perspective view of the inducer hub and blade assembly of FIG. 2.

Referring now to FIGS. 2-4, wherein the drawings illustrate a preferred embodiment of the invention only and are not intended to limit same, FIG. 2 illustrates an inducer 100, which as noted above, can be incorporated in the pump and motor unit 10 for a pumping system for pressurized cryogenic gas storage reservoirs. The inducer of the present invention overcomes the problems associated with air so that once the pumped two phase medium has passed part way through the inducer the medium is a single phase liquid. This is achieved with the inducer design illustrated in FIGS. 2-4 and described herein.

More particularly, a central hub 110 of the inducer includes an opening 112 therethrough to secure the inducer to the drive shaft 14 extending from the motor 12. The first end of the hub has a rounded end (i.e., no sharp edges or contours) and a curvilinear conformation that proceeds from the end as best seen in FIGS. 2 and 3, extending both generally radially outward from the shaft and extending axially therealong. The hub extends from a recess 114 formed in the end and curves outwardly to a first generally constant diameter hub portion 116. Leading edges of first, second, and third helical blades **120*a*-120*c* extend radially and axially outward from the hub—particularly extending from the constant diameter portion thereof. As will be appreciated, the leading edges 122*a*-122*c* corresponding to each of the blades are circumferentially spaced approximately 120° from the leading edge of the next adjacent blade. The thicknesses of the blades increases or tapers from the leading edges 122***a*-122*c* to a substantially constant thickness over the remainder of the blades represented by reference numerals 124*a*-124*c*, proceeding to respective trailing edges 126*a*-126*c*. As is perhaps best represented in FIGS. 2 and 3, each blade is identical to the other blades and extends circumferentially approximately 180° from the leading edge 122*a*-122*c* to the respective trailing edge 126*a*-126*c*. Each blade has a helical or spiral conformation as it extends circumferentially about the hub and also extends axially from the generally constant diameter portion 116 of the hub toward an enlarged diameter portion of the hub 130 (FIGS. 3 and 4). As will be appreciated, the hub increases in diameter between the first or leading ends of the blades and the second or axially spaced trailing ends thereof. Stated another way, the hub contour is not simply a constant taper, and advantageously does not incorporate any sharp edges over its length.

Interposed between the three primary blades 120 are secondary or splitter blades. The splitter blades are situated to "carry" more flow through the inducer. Thus, by the time flow has reached the trailing end of the inducer, it is being pumped by six blades rather than the three original blades at the inlet end. The primary blades have a greater twist to aid in compressing the vapor and this increased twist also provides greater spacing in an axial direction (i.e., parallel or along the rotational axis) that accommodates the splitter blades. As noted, three splitter blades 150*a*, 150*b*, 150*c* are provided, one between each of the primary blades. Each splitter blade 150*a*-150*c* has a tapering leading edge 152*a*-152*c* and a trailing edge 156*a*-156*c*. As perhaps best exemplified in FIGS. 2 and 4, the leading edges 152 of the splitter blades are circumferentially spaced about 60° from the leading edges 122 of the primary blades. Each tapering leading edge 152*a*-152*c* merges into a more substantially constant thickness over the remaining circumferential extent of the blade profile, represented by reference numerals 154*a*-154*c*. The circumferential extent from the leading edge 152 to the trailing edge 156 of each splitter blade is approximately 150°.

As is perhaps best illustrated in FIG. 3, the hub continues to increase in diameter as it proceeds from the leading edge of the blade toward the trailing ends thereof. Where the flow exits each of the primary and splitter blades, however, the hub has a generally constant diameter and a smoothly rounded contour where it terminates at the second end 160. The configuration of the hub serves the purpose of a minimum back pressure at the leading edge. This makes it easy for the fluid to be introduced into the blades of the inducer. The high twist angle of the blades serves a compressor-like function, compressing the vapor so that the pumped medium is converted from a two-phase medium of both air and liquid to a single-phase or liquid by the time it exits the inducer. Thus, the blades, as well as the increasing diameter of the hub, provide this compressing action.

Whereas a fan-type inducer may achieve a vapor-to-liquid ratio (V/L) of 0.2 to 0.3 therethrough, and a mix flow inducer has a ratio of 0.4 to approximately 0.45, the inducer of the present invention has an approximately 1:1 ratio of the vapor-to-liquid (V/L).

The depth of the blade, i.e., the dimension of the blade measured in a generally radial direction from the hub out to the outer diameter edge of the blade is also quite different in accordance with the present invention. Whereas a mixed flow pump will typically have an increasing blade depth at the trailing edge or outlet compared to the depth at the leading edge or inlet, such is not the case in the present invention. Here, the depth of the blade measured from the hub to the tip is substantially greater at the inlet than at the outlet (see FIG. 3). The outer diameter of the blade is essentially unchanged from the leading edge to the trailing edge, but since the hub diameter increases from the leading or inlet end to the trailing or outlet end, the depth of the blades decreases over this axial extent. As noted above, this configuration also contributes to the improved vapor-to-liquid pumping ratio of the inducer assembly.

Incorporating this inducer design into the pump assembly results in a substantial reduction in retained or residual fuel left in the reservoir. Whereas prior arrangements resulted in approximately four (4) feet (1.22 meters) of residual LNG remaining in the reservoir, the subject invention substantially reduces the residual depth to approximately eight (8) inches or 0.66 feet (0.2 meters). With an estimated cost of one hundred thousand dollars ($100,000) per year per foot associated with transporting the LNG that has not been pumped from the ship reservoir, a substantial savings is associated with the ability to pump off a greater amount of LNG, i.e., to reduce the residual depth of remaining LNG in the reservoir.

This high vapor handling high performance inducer could be applied to handle boil-off gas problems in multi-stage high pressure pumps. Its excellent aero/hydrodynamic blade design makes it less susceptible to cavitation. Its high pump head capability compresses any gas present, whether through entrainment or cavitation to be reabsorbed into the liquid phase. The high performance inducer will operate with stability at low flow rates at or even below 10% of rated flow, due to features of the design that control recirculation within the inducer. These capabilities offer the possibility that the high performance inducer could obviate the need for a recondenser with this inducer serving that purpose. The potential cost savings are potentially large.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A high performance inducer for pumping cryogenic two phase fluids from reservoirs comprising:

a hub including a first portion having a first diameter and a second portion having a second diameter larger than the first diameter, wherein the hub increases in diameter from the first portion to the second portion;

a plurality of primary blades having a generally helical conformation circumferentially disposed about the hub, each primary blade having a first length; and a plurality of secondary blades circumferentially disposed about the hub, each secondary blade being interposed between two primary blades and having a second length different than the first length, wherein an outer diameter of each primary blade and each secondary blade is generally constant from a leading edge to a trailing edge of said primary and secondary blades.

2. The invention of claim 1 wherein a radial depth of the plurality of primary and secondary blades is substantially greater at the first portion of the hub than at the second portion of the hub.

3. The invention of claim 1 wherein the first portion includes a generally rounded end and a sidewall extending both radially outward and axially from the rounded end.

4. The invention of claim 3 wherein the sidewall has a general curvilinear conformation.

5. The invention of claim 1 wherein the primary blades extend circumferentially about the hub generally 180 degrees from a leading edge to a trailing edge thereof.

6. The invention of claim 1 wherein a leading edge of each primary blade is circumferentially spaced generally 120 degrees from a leading edge of an adjacent primary blade.

7. The invention of claim 1 wherein a leading edge of each secondary blade is circumferentially spaced generally 60 degrees from a leading edge of an adjacent primary blade.

8. The invention of claim 7 wherein a circumferential extent from the leading edge of each secondary blade to a trailing edge thereof is generally 150 degrees.

9. The invention of claim 1 wherein the primary blades and the secondary blades have a thickness that tapers from a leading edge of said primary and said secondary blade to a substantially constant thickness over the remaining circumferential extent of said primary and said secondary blades.

10. In a submersible pump of the type used to pump a two phase liquid from a cryogenic storage system, an inducer impeller for pumping a two phase fluid comprising:

a hub including a first portion having a first diameter and a second portion having a second diameter, wherein the hub increases in diameter from the first portion to the second portion;

a plurality of axially extending identically shaped primary blades having a general helical conformation circumferentially disposed about the hub and a leading edge extending radially and axially from the hub;

a plurality of axially extending secondary blades circumferentially disposed about the hub such that one of the secondary blades is interposed between two adjacent primary blades, the secondary blades being shorter in length than the primary blades; and wherein an outer diameter of each primary blade and each secondary blade is generally constant from a leading edge to a trailing edge of said primary and said secondary blade.

11. The invention of claim 10 wherein the depth of the plurality of primary and secondary blades is substantially greater at the first portion of the hub than at the second portion of the hub.

12. The invention of claim 10 wherein the vapor-to-liquid ratio (V/L) of the pumped fluid is up to about a 1:1 ratio.

* * * * *